United States Patent [19]

Hallagin

[11] 4,022,293

[45] May 10, 1977

[54] FOLD-AWAY HOOK PLATFORM

[76] Inventor: Elmer L. Hallagin, Box 89, McDonald, Kans. 67745

[22] Filed: Feb. 23, 1976

[21] Appl. No.: 660,708

[52] U.S. Cl. ..... 182/150; 182/152

[51] Int. Cl.[2] ..... E04G 3/10

[58] Field of Search ..... 182/152, 150, 178, 155

[56] References Cited

UNITED STATES PATENTS

| | | | |
|---|---|---|---|
| 1,115,975 | 11/1914 | Robertson | 182/179 |
| 2,878,078 | 3/1959 | Moultrop | 182/150 |
| 3,135,351 | 6/1964 | Economos | 182/150 |
| 3,158,223 | 11/1964 | Brown | 182/150 |
| 3,231,043 | 1/1966 | Brown | 182/150 |

*Primary Examiner*—Reinaldo P. Machado

*Attorney, Agent, or Firm*—John H. Widdowson; Edwin H. Crabtree

[57] ABSTRACT

A fold-away hook platform used as a scaffold for mounting to a structure such as the side of a railroad car. The platform having a pair of scaffold arms with upper end portions having hook portions extending therefrom for quickly mounting to a door, gate, or wooden cribbing. The lower end portion of the scaffold arms adapted for receiving the ends of a board for standing on while working on the platform. The platform is held rigidly in place by scaffold bracing pivotally attached to each scaffold arm.

6 Claims, 5 Drawing Figures

FOLD-AWAY HOOK PLATFORM

BACKGROUND OF THE INVENTION

This invention relates generally to scaffolds or temporary platforms for working on and more particularly but not by way of limitation to a platform for mounting on the side of a railroad boxcar.

In the loading out of grain into a railroad boxcar or grain car and the treating of the grain with a fumigant it is necessary for workmen to work along side the railroad boxcar. Because of the height of the boxcar door above the ground surface a temporary platform or scaffold is required so that workmen can handle the grain load out spout which is pivoted into the top of the boxcar. Also a temporary platform is needed to support the containers of grain fumigant and the necessary equipment used in treating the grain in the boxcar.

Heretofore workmen have used ladders, improvised scaffolds, or have stood on top of the boxcar or hung on the side of the boxcar with one hand. These methods were unsatisfactory and dangerous to the safety of the workmen. Also both of the workmen hands were not free for handling the equipment involved.

There are prior art scaffolds, ladders, and folding support steps that are used having hooked supporting arms for securing to the sides of a structure. None of these prior arts scaffolds are similar in structure and have the advantages of the subject fold-away hook platform as disclosed herein.

SUMMARY OF THE INVENTION

The subject invention can be quickly mounted to the side of a railroad boxcar door, a gate, an open siding and wooden cribbing used to enclose the railroad door opening. The platform is simple in design and provides working room for two or three men to work safely thereon for moving a load out grain spout into and out of the top of the boxcar. The platform also provides room for holding containers of fumigant and the necessary equipment for treating the grain in the boxcar. Also the platform allows the workmen freedom of movement and allows them to use both hands in the handling of the equipment and containers.

The platform is rigidly secured against the side of the structure and it is mounted on and held in place by scaffold bracing to prevent movement thereon. Also the scaffold arms are adaptable for receiving various lengths and widths of boards used for standing on. The lower portion of the scaffold arms receive the end portions of the board and prevent the ends of the board from tipping upward should an uneven load be placed on one side of the platform.

When the loading of grain into the boxcar is completed and the grain is fumigated, the fold-away hook platform can be quickly removed with the scaffold braces folded against the sides of the scaffold arms and the board removed from the lower portion of the scaffold arms. The fold-away hook platform can then be hung in a convenient place until its use is required at a later date.

The fold-away hook platform includes a pair of vertical scaffold arms. The arms include an upper portion having a hook portion extending rearwardly therefrom for attaching the platform to a structure such as the side of a boxcar. A lower portion of the scaffold arms includes an angular looped portion extending outwardly from the arms for receiving the end portions of a board thereon. A pair of scaffold braces are pivotably attached to the scaffold arms. The opposite ends of the braces are slidably receiving in bushings mounted on the scaffold arms to rigidly secure the scaffold arms and the board against the side of the railroad car.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
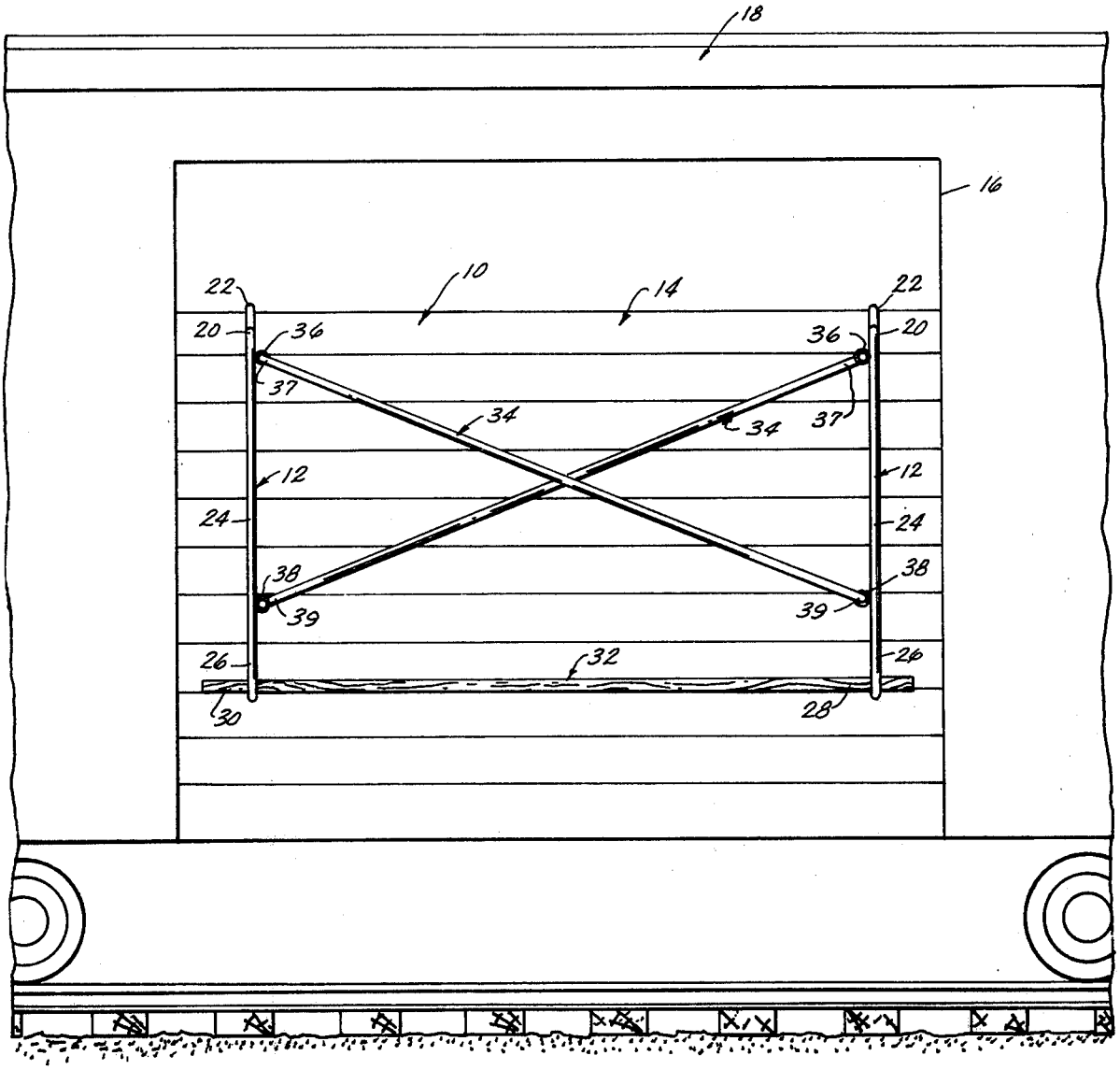
FIG. 1 is a side view of the fold-away platform mounted on the side of a railroad car.

In FIG. 1 the fold-away hook platform is designated by general reference numeral 10. The platform 10 includes a pair of scaffold arms 12 adjacently disposed and vertically mounted on wooden cribbing 14 for enclosing a door opening 16 in a railroad boxcar 18. The scaffold arms 12 include an upper end portion 20 having a hook portion 22 extending rearwardly therefrom, a vertical elongated center portion 24, and a lower end portion 26 for receiving the end portions 28 and 30 of a board 32. The board 32 and the scaffold arms 12 are secured to the sides of the wooden cribbing 14 by scaffold braces 34. The braces 34 are pinned inside an upper bushing 36 mounted to the center portion 24 of the arms 12. The opposite end of the braces 34 is slidably received into a lower bushing 38 mounted to the center portion 24 of the adjacent scaffold arms 12.

Figure 2:
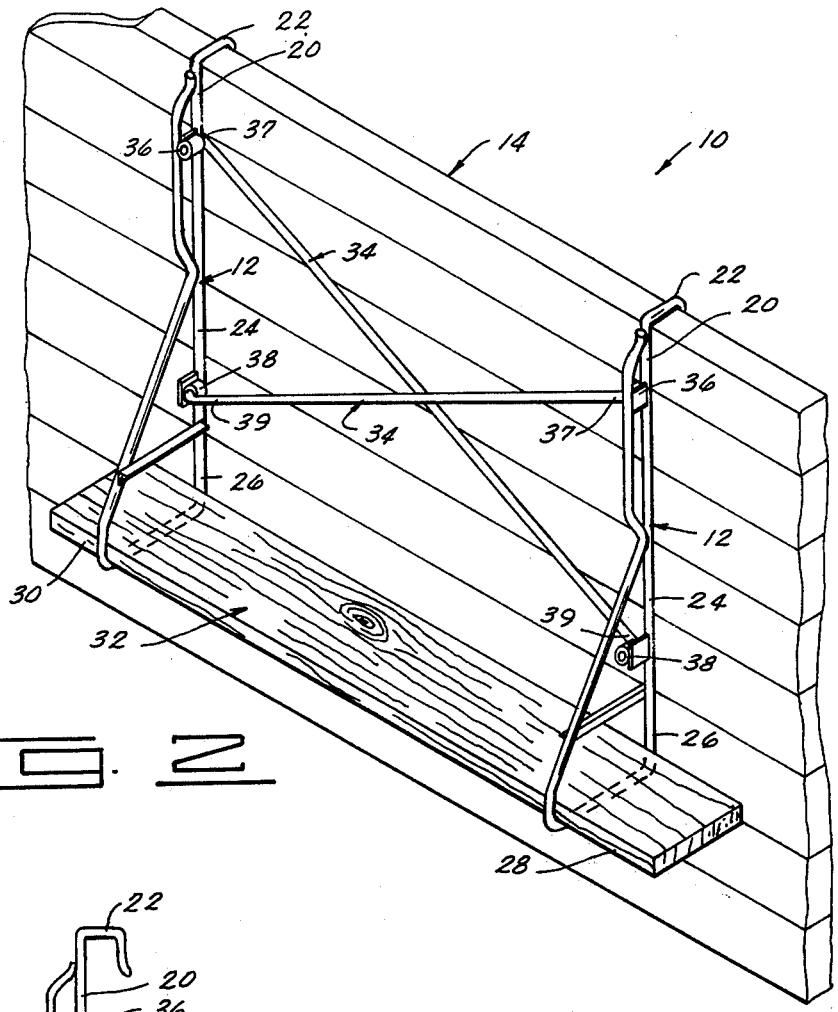
FIG. 2 is a perspective view of the fold-away hook platform.

In FIG. 2 a perspective view of the platform 10 is shown. In this view the platform 10 is attached to the wooden cribbing 14. It should be understood that while the cribbing 14 is shown other structures such as the side of a railroad car, a gate, or a door can work equally well wherein the hook portion 22 of the scaffold arms 12 can be received thereon. An upper end portion 37 of the scaffold braces 34 can be seen pivotally mounted inside the upper bushing 36 of the scaffold arms 12. A lower end portion 39 of the braces 34 is seen slidably received in the lower bushings 38. By crossing the scaffold bracing 34 is shown and attaching the bracing 34 to the opposite scaffold arm 12 the scaffold arms 12 and the board 32 are held rigidly in place against the side of the wooden cribbing 14.

Figure 3:
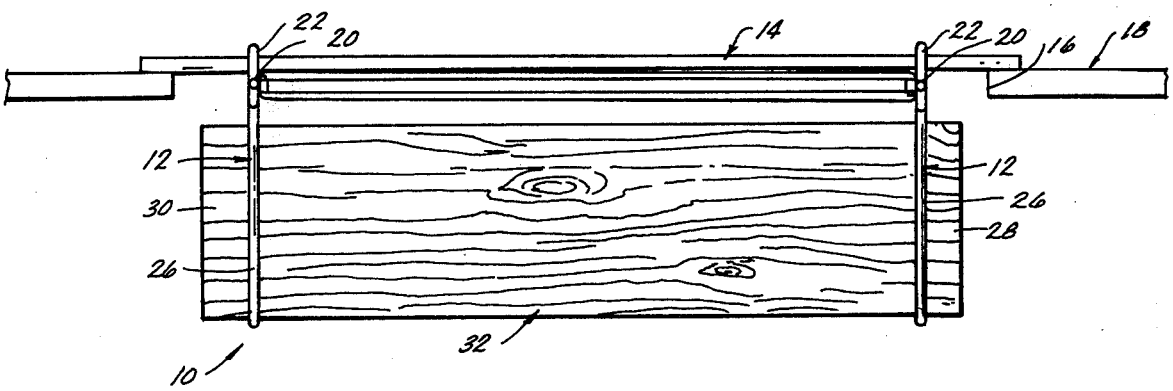
FIG. 3 is a top view of the fold-away hook platform.

In FIG. 3 a top view of the platform 10 is shown. In this view the upper portion 20 and the center portion 24 of the scaffold arms 12 can be seen disposed adjacent the side of the wooden cribbing 14 with the hook portion 22 disposed over the top of the wooden cribbing 14 and hooked against the opposite side.

The lower portion 26 of the scaffold arms 12 can be seen extending outwardly from the side of the railroad car 18 for receiving the end portions 28 and 30 of the board 32.

Figure 4:
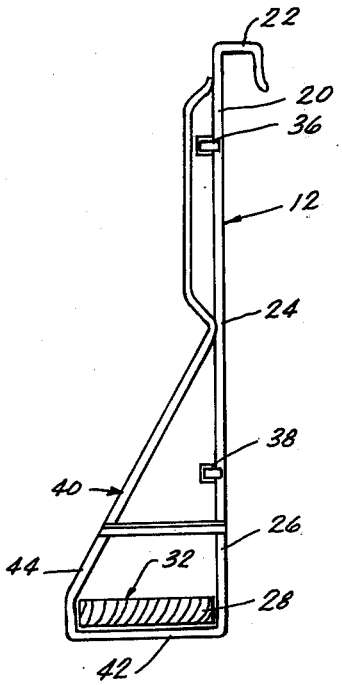
FIG. 4 is a side view of the scaffold arm.

In FIG. 4 a side view of the scaffold arm 12 is shown. Attached to the sides of the center portion 24 of the scaffold arms 12 is the upper bushing 36 and the lower bushing 38. Integrally formed in the lower portion 26 of the scaffold arms 12 is an angular loop 40 wherein a bottom portion 42 of the angular loop 40 is substantially horizontal for receiving the end portion 28 of the board 32 thereon. An outer portion 44 of the angular loop 40 is angled inwardly above the end portion 28 of the board 32. By providing the angular loop 40 as shown a board 32 of various dimensions can be received therein for quickly setting up the platform 10. When the platform 10 is in use and men and equipment are supported by the board 32, the weight may become unbalanced on one side of the platform 10. Should this happen the upward movement or tilting of the board 32 is prevented by the angled outer portion 44 restricting the upward travel of the end portion 28 in the loop 40.

Figure 5:
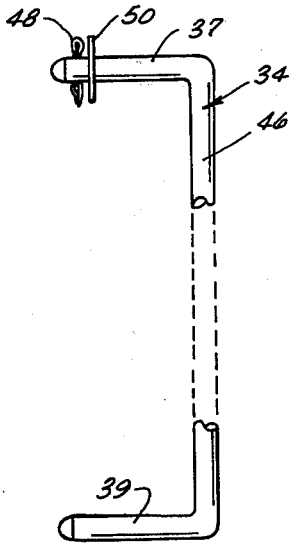
FIG. 5 is a side view of the scaffold brace.

In FIG. 5 the scaffold brace 34 is shown having the first end portion 37 integrally formed at right angles to an elongated center portion 46 of the brace 34. The first end portion 35 includes a pin 48 and a washer 50 used for securing the first end portion 35 in the upper bushing 36 as shown in FIG. 2. When the platform 10 is removed from the attached structure the scaffold brace 34 pivots in the bushing 36 allowing the brace 34 to be disposed against the side of the scaffold arms 12 for convenience in the storage of the platform 10. The second end portion 39 is also intergrally formed in the brace 34 and is at right angles to the elongated center portion 46. The second end portion 39 is slidably received in the lower bushing 38 of the oppositely disposed scaffold arms 12 for rigidly securing the scaffold arms 12 against the structure it is attached to. By slidably inserting the second end portion 39 of the braces into the lower bushing 38, the scaffold braces 34 can be quickly attached to the opposite scaffold arms 12 for erecting the platform 10. Also, when it is desired to remove the platform 10, the second end portion 37 of the brace 34 can be quickly removed from the lower bushing 38.

In operation the fold-away hook platform 10 is mounted to the side of a railroad car 18 by placing the hook portion 22 of the scaffold arms 12 over the top of the wooden cribbing 14 as shown in FIGS. 1, 2, and 3. The scaffold arms 12 are hung vertically in a spaced relationship to each other. The pivotably attached scaffold braces 34 are pivoted in the upper bushings 36 mounted to the center portion 24 of the scaffold arms 12, and the second end portions 37 of the scaffold braces 34 inserted into the lower bushings 38 attached to the center portion 24 of the opposite scaffold arm 24. A board 32, or any other suitable material for standing on, is inserted through the looped portion 40 of the lower portion 26 of the scaffold arms 12. The end portions 28 and 30 of the board 32 rest on the horizontal portion 42 of the loop portion 40. The platform 10 now is ready for placing equipment, fumigant containers and workmen thereon while loading out the railroad car 18 with grain from a grain spout which is pivoted into the railroad car 18. When the loading out of the grain is completed and the grain is fumigated the equipment and workmen are removed from the platform 10. The platform 10 then can be quickly removed from the railroad car 18 by removing the board 32 from the scaffold arms 12. The scaffold braces 34 are released from the lower bushings 38 and the scaffold arms 12 and braces 34 are folded against each other and removed from the sides of the wooden cribbing 14.

Changes may be made in the construction and arrangement of the parts or elements of the embodiments as disclosed herein without departing from the spirit or scope of the invention as defined in the following claims.

I claim:

1. A fold-away hook platform used as a scaffold, the platform comprising:

a pair of vertical scaffold arms positioned adjacent to each other in a spaced relationship, said arms having an upper portion, a center portion, and a lower portion, the upper portion of said arms having a hook portion extending rearwardly therefrom for attaching the platform to a structure;

a board for standing on, the end portions of said board resting on the lower portion of said arms and supported thereby; and a pair of scaffold braces, the one end of said braces pivotally attached to said arms, the opposite of said braces removably attached to said adjacent scaffold arm, said braces cross in an X configuration when attached to said scaffold arms.

2. The platform as described in claim 1, wherein said scaffold braces include an elongated center portion, a first end portion, and a second end portion, said end portions integrally formed at right angles to the elongated center portion of said scaffold braces.

3. The platform as described in claim 2, wherein said scaffold arms include an upper bushing and a lower bushing attached to the center portion of said arms, the first end portion of said scaffold braces pivotally mounted in said upper bushing, the second end portion of said braces slidably received in the lower bushing of said adjacent scaffold arm.

4. The platform as described in claim 1, wherein the lower portion of said scaffold arms extend outwardly at right angles from the lower portion of said arms for receiving the end portions of said board thereon.

5. The platform as described in claim 1, wherein the lower portion of said scaffold arms extends outwardly at right angles from the lower portion of said arms, the lower portion forming an enclosed angular loop, the bottom portion of said loop is substantially horizontal, the outer portion of said loop angles inwardly toward the center portion of said arms and attached thereto, the loop receiving the end portions of said board therein and preventing the board from raising at one end thereof.

6. A fold-away hook platform used as a scaffold, the platform comprising;

a pair of vertical scaffold arms positioned adjacent to each other in a spaced relationship, said arms having an upper portion with a hook portion extending rearwardly therefrom for attaching the platform to a structure, a vertical center portion, and a lower angular looped portion extending outwardly from the center portion, the bottom portion of said loop portion being substantially horizontal, the outer portion of said loop portion angled inwardly toward the center portion of said arms and attached thereto;

an upper bushing and a lower bushing attached to the center portion of each of said scaffold arms;

a pair of scaffold braces, the braces having an elongated center portion and a first end portion and a second end portion, the end portions formed at right angles to the center portion of said braces, the first end portion of said braces received in the upper bushings of said scaffold arms and pinned thereto, the second end portion of said braces slidably received in the lower bushing of said adjacent scaffold arm for rigidly securing said scaffold arms in place against the structure; and a board for standing on, the end portions of said board slidably received and resting on the bottom portion of the looped portion of said scaffold arms.

* * * * *